US005358113A

United States Patent [19]

Hellenbrand

[11] Patent Number: 5,358,113

[45] Date of Patent: Oct. 25, 1994

[54] DISPENSER FOR TAPE ROLLS

[75] Inventor: Ronald G. Hellenbrand, Middleton, Wis.

[73] Assignee: Miles Kimball Company, Oshkosh, Wis.

[21] Appl. No.: 120,693

[22] Filed: Sep. 13, 1993

Related U.S. Application Data

[63] Continuation of Ser. No. 897,502, Jun. 11, 1992, abandoned.

[51] Int. Cl.[5] ..... B65D 85/671; B65H 35/04

[52] U.S. Cl. ..... 206/411; 206/409; 206/463; 206/470; 206/471; 225/41; 225/48; 225/49; 225/53

[58] Field of Search ..... 225/41, 39, 40, 43, 225/46, 48, 49, 52, 53, 77, 80; 206/389, 395, 408, 409, 411, 463, 470, 471

[56] References Cited

U.S. PATENT DOCUMENTS

| | | | |
|---|---|---|---|
| 1,408,499 | 3/1922 | Casterline et al. | 225/53 |
| 3,102,671 | 9/1963 | Gershen | 225/48 |
| 4,244,502 | 1/1981 | Reed | 225/43 |
| 4,262,835 | 4/1981 | Wrobel | 225/38 |
| 4,512,474 | 4/1985 | Harding | 206/470 X |
| 4,700,835 | 10/1987 | Rognswoog, Jr. | 225/48 |
| 4,872,551 | 10/1989 | Theros | 206/471 X |
| 4,899,877 | 2/1990 | Kiernan | 206/471 X |
| 5,129,516 | 7/1992 | Theros | 206/389 |

OTHER PUBLICATIONS

Exhibits 1 and 2 are photographs of a postage stamp dispenser. (admitted prior art).

Exhibits 3 and 4 are photographs of a correction tape dispenser. (admitted prior art).

Exhibit 5 is a photograph of a stand-alone tape dispenser. (admitted prior art).

*Primary Examiner*—Rinaldi I. Rada
*Assistant Examiner*—Clark F. Dexter
*Attorney, Agent, or Firm*—Quarles & Brady

[57] ABSTRACT

A dispenser for a roll of adhesive labels or other types of tape rolls employs two sidewalls hinged to a third intermediary base wall to close and create a pocket for holding the tape roll while allowing the roll to rotate for dispensing. The base wall has a face for supporting the dispenser on a desk and the tape may be dispensed through a slot formed by the interface of the two sidewalls. Interfitting embossments in the two sidewalls allow the dispenser to be opened for removing or inserting a new roll of tape. A window cut in one sidewall allows advancing or stopping the tape with finger pressure against the tape. The dispenser is advantageously produced from a single piece of plastic.

8 Claims, 2 Drawing Sheets

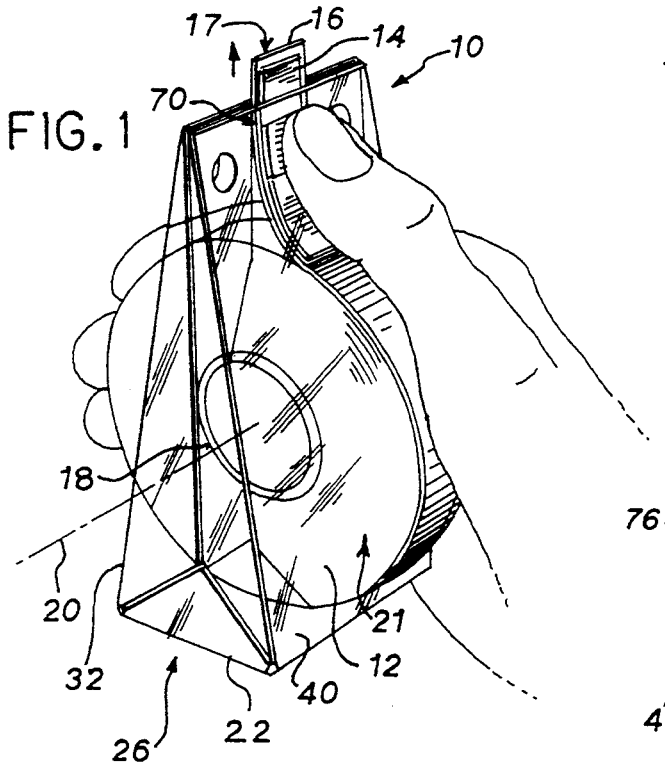
FIG. 1
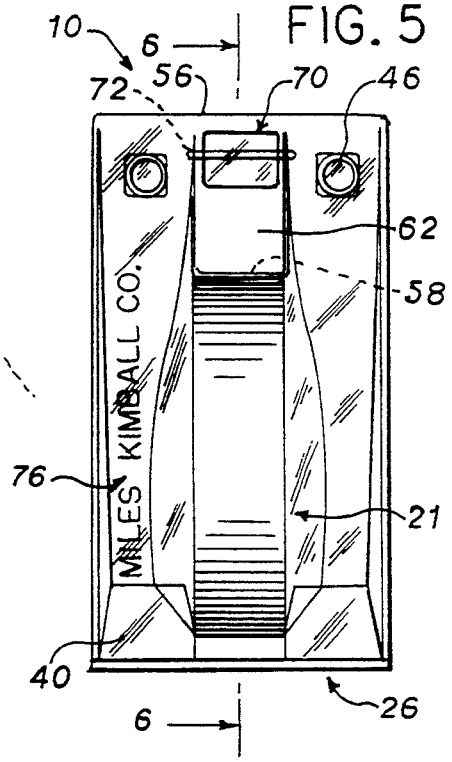
FIG. 5
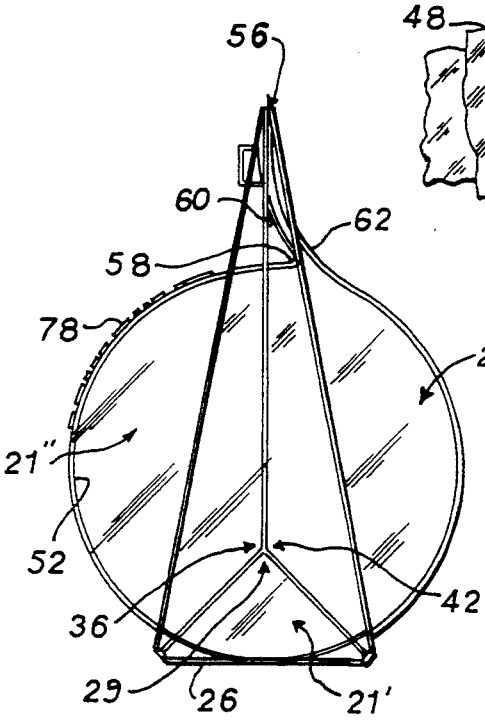
FIG. 4
FIG. 7
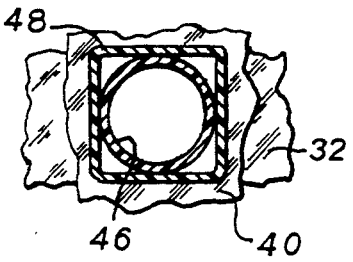
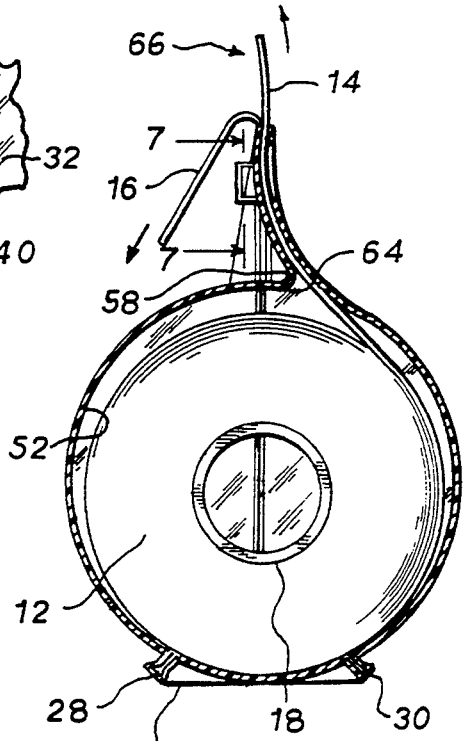
FIG. 6

FIG. 2
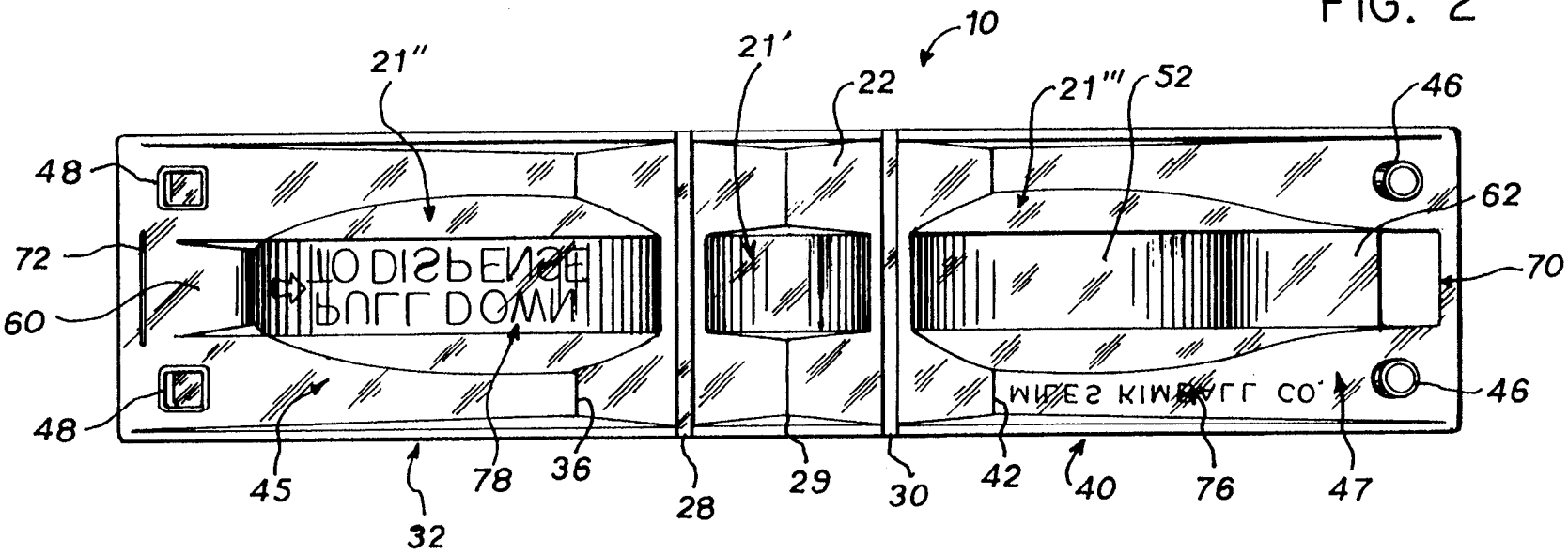
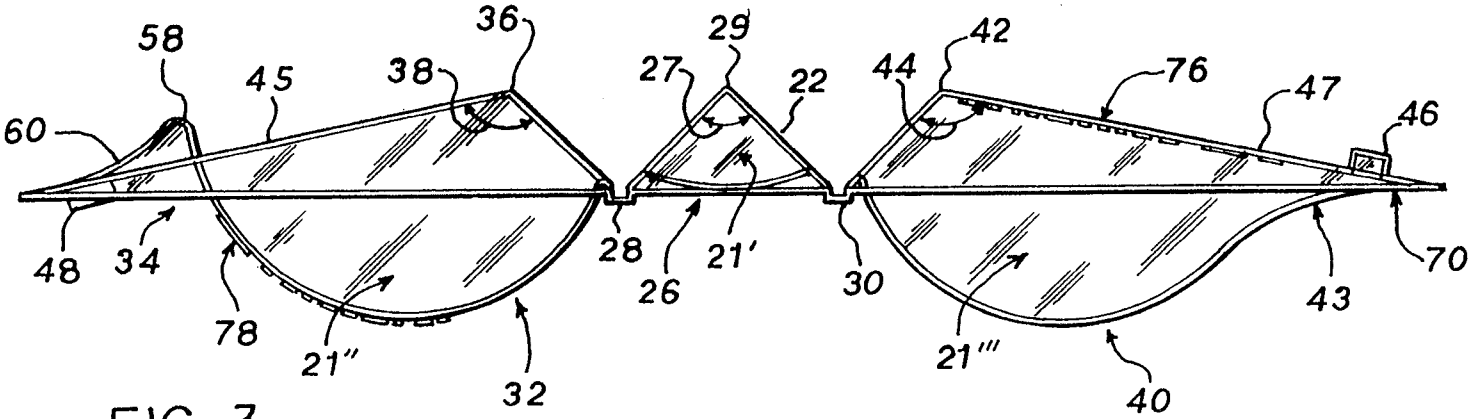
FIG. 3

DISPENSER FOR TAPE ROLLS

This application is a continuation, of application Ser. No. 07/897,502, filed Jun. 11, 1992, now abandoned.

BACKGROUND OF THE INVENTION

1. Field of the Invention

The invention relates to dispensers for storing and dispensing rolls of tape. It appears to be especially well suited for use with tapes formed of adhesive labels applied to a non-adhesive backing strip or tapes that are otherwise not adhesive as stored, such as linked postage stamps.

2. Background Art

"Self-adhesive" labels are well known in the art and consist, for example, of a die cut paper blank having a pressure sensitive adhesive coated on one side. The adhesive is covered and protected by a releasable backing, typically a specially coated paper. The backing may be peeled away from the label so that the adhesive of the label is exposed and so that the label may be attached to its intended surface.

Such labels may be manufactured and sold in page-like sheets, each sheet holding labels arranged in a rectangular array. With large numbers of labels, however, it is preferable to manufacture the labels as a continuous ribbon, with the backing sheet being formed as a non-adhesive tape and the labels attached at regularly spaced intervals. In tape form, the labels may be rolled into a compact volume.

The roll form of labels, when used with a dispenser of proper design, allows the labels to be removed easily, one at a time, with a minimum of waste, and protects the unused labels from damage or soiling such as may occur when the labels are held on sheets.

A number of types of dispensers for rolls of adhesive tape are well known. In such dispensers, the adhesive on the tape holds the tape in roll form and serves to temporarily anchor the end of the tape to the dispenser. Such dispensers are generally not suitable for tapes with no exposed active adhesive (e.g. rolls of postage stamps). Dispensers suitable for tapes without exposed active adhesive require an ancillary means for holding the end of the tape in position.

One dispenser for non-adhesive tape employs a box-like tray sized to receive the roll of tape so that the roll may rotate within the tray. A conforming separately formed cover fits over the box-like tray to provide a slot between one of its walls and an opposing wall of the tray. The length of slot provides frictional contact with the tape to resist undesired movement of the tape. A finger hole permits advancing the tape within the dispenser or holding the tape for tearing off a portion.

Stand alone dispensers designed to hold and dispense non-adhesive tapes in an attractive and convenient manner on a desk or work space may cost as much or more than the tape they contain. Potential purchasers of non-adhesive tapes, especially those who use small amounts of tape, may be discouraged by the need to purchase a separate dispenser. For those who need to purchase a variety of tapes, the purchase of multiple stand alone dispensers is unduly burdensome.

The use of stand alone dispensers also often requires that the tapes have additional packaging for sale or shipment. Such primary packaging, which is discarded when the tape is loaded into the dispenser, ultimately increases the cost of the tape.

Accordingly, there is a need for a low cost dispenser that may be distributed with tapes and which may serve also as a protective primary packaging during sales and shipment. In this regard, it is known to package rolls of self-adhesive labels or the like in cardboard boxes where the lid of the box provides a slot for dispensing the tape of labels. These boxes, however, are less than fully satisfactory as dispensers because they lack the desired stiffness and resilience for frequent use. Further, for narrow tapes, the box dimensions are also narrow and thus awkward to store and use.

SUMMARY OF THE INVENTION

The present invention provides a dispenser for non-adhesive rolls of labels or the like. In particular, the invention employs a low cost package that may serve as the primary package for the labels, for sales and shipping, and yet which provides a durable dispenser appropriate for work surface storage. The dispenser can be preferably formed from a single piece of plastic.

In one embodiment, the dispenser includes a base wall having opposed first and second hinge edges. A first sidewall is hingeably attached to the base wall at the first hinge edge to fold between an open position, generally co-planar with the base wall, and a closed position folded inward towards the base wall. A second sidewall hingeably attaches to the base wall at the second hinge edge also to fold between the open and closed positions like the first sidewall. In the closed position, the first and second sidewall together form a pocket for retaining the roll so that the roll is free to rotate about its axis to dispense tape from the roll. In the open position, the first and second sidewall open to allow the roll to be removed or inserted into the pocket.

It is one object of the invention to provide a dispenser that may be inexpensively fabricated as a single piece which is then simply folded to hold the roll. The hinged construction allows the entire assembly of the base wall and first and second sidewalls to be opened for easy molding.

The construction allows the creation of a planar base surface of arbitrary size independent of the roll dimensions. This planar base surface allows the dispenser to sit stably on the work surface. The dispenser may be constructed of a transparent material providing easy visual identification of the enclosed labels.

It is another object of the invention to provide an inexpensive dispenser that may be conveniently stored on a work surface and which displays the labels for quick identification.

A releasable fastener may be used to fasten the first and second sidewalls in abutment in the closed position to hold the roll.

It is thus another object of the invention to provide an inexpensive dispenser which allows easy access to the pocket for replacement or adjustment of the roll.

The slot of the dispenser may be formed between the abutment of the first and second sidewalls in the closed position and may project upward from the base.

It is another object of the invention to provide a dispensing slot without additional manufacturing steps, which directs a protruding strip of tape away from the work surface to prevent it from being soiled or from interfering with work on the work surface.

The dispenser pocket may be generally cylindrical with a circular periphery. The periphery may include a tooth for catching the end of the roll when the roll is inserted in the pocket and rotated and for directing the end into the slot. The slot or another part of the dispenser may include a thumb hole for advancing the tape further out of the dispenser or for holding the tape for tearing.

Other objects and advantages besides those discussed herein will be apparent to those skilled in the art from the description of the preferred embodiment of the invention which follows. Thus in the description, reference is made to the accompanying drawings, which form a part hereof, and which illustrate one example of the invention. Such example, however, is not exhaustive of the various alternative forms of the invention. Therefore reference should be made to the claims which follow the description for determining the full scope of the invention.

BRIEF DESCRIPTION OF THE DRAWINGS

FIG. 1 is a perspective view of a first embodiment of the present invention in a closed position showing placement of the roll of tape within the dispenser and the positioning of a hand about the dispenser to use the thumb slot for advancing or stopping of the tape;

FIG. 2 is a top plan view of the dispenser of FIG. 1, in the open state as it would be manufactured, showing embossing of the surface with directions for use;

FIG. 3 is a side elevation view of the FIG. 2 dispenser;

FIG. 4 is a side elevation view of the dispenser in the closed position, without a roll of tape;

FIG. 5 is a front elevation view similar to that of FIG. 4;

FIG. 6 is a cross-section along lines 6—6 of FIG. 5 showing the guiding of the roll of tape into the slot of the dispenser and the release of the backing of the tape during normal use of the dispenser; and FIG. 7 is a detail of the releasable fastening means shown in FIG. 6.

DETAILED DESCRIPTION OF THE PREFERRED EMBODIMENT

Referring to FIGS. 1 and 2, a tape dispenser 10 of the present invention holds a roll 12 of self-adhesive labels 14 attached to a continuous backing strip 16 to provide a non-adhesive tape 17. The tape 17 is wound around a cylindrical cardboard tube 18 so that each successive layer of the tape 17 spirals outward around the tube 18 in a counterclockwise direction. The roll 12 is generally cylindrical about an axis 20 passing through the tube 18.

Referring generally to FIGS. 1, 2 and 3, the tape dispenser 10 includes a base wall 22 having an outline conforming generally to an isosceles triangular prism having a longitudinal axis aligned with axis 20 of the roll 12. The base wall 22 is formed of a single concave sheet opening downward to a rim 26, the latter which define generally a plane for supporting the bottom of the base wall 22 against a flat work surface (not shown). An apex ridge 29 extends longitudinally along the base wall 22 opposite the rim 26 and defines an apex angle 27, external to the base wall 22.

Longitudinal hinges 28 and 30 flank the base wall 22 at opposing sides of its rim 26 and consist of planar strips of the same material from which base wall 22 is formed. The planar strips of the hinges 28 and 30 are subject to bending, on account of their planar shape, along an axis parallel to axis 20. In contrast, the prismatic configuration of the base wall 22 effectively braces it against bending along or across its longitudinal axis.

Attached to a hinge edge of the base wall 22 by hinge 28 is a first sidewall 32 having the same longitudinal dimension as the base wall 22 and conforming in outline generally to a scalene triangular prism. Sidewall 32 is also formed of a single concave sheet and opens downward to a rim 34 defining a plane which is generally co-planar with that of rim 26 of the base wall 22 when the sidewall 32 is in the open position. An apex ridge 36 extends longitudinally along the sidewall 32 opposite the rim 34 and has an apex angle 38 similar to that of the base wall 22.

A second sidewall 40, similar to sidewall 32, is joined to a hinge edge of the base wall 22 along hinge 30. Sidewall 40 is substantially the mirror image of sidewall 32, also being in the form of a scalene triangular prism and having a rim 43 defining a plane generally co-planar with that of the rim of base wall 22 when sidewall 40 is in the open position. An apex ridge 42 having apex angle 44 runs longitudinally along second sidewall 40 opposite the rim 43.

It will be understood that in the open position that sidewalls 32 and 40 and base wall 22, as attached by hinges 28 and 30 may be formed as a single piece through a thermoforming process in which a single sheet of plastic material is drawn to the desired shape over properly configured forms.

Referring now to FIG. 4, in the closed position, hinges 28 and 30 are flexed so that the sidewalls 32 and 40 are folded upward so that apex ridges 29, 36 and 42 are brought together. The apex angles 27, 38 and 44 are designed to add to 360° so that when the apex ridges 29, 36 and 42 are brought together, the upper faces of the prisms of the sidewalls 32 and 40 and the base wall 22 fit in abutment to create a rigid package that resists both flexure and torsion. In particular, outward faces 45 and 47 of sidewalls 32 and 40, respectively, are parallel and in contact.

In a closed position, shown in FIG. 1, the dispenser 10 provides a generally cylindrical pocket 21 for receiving the roll 12 and allowing the roll 12 to rotate therein when the axis 20 of the roll 12 is aligned to be longitudinal. The pocket 21 has a central longitudinal axis which extends substantially parallel to the first and second hinges 28 and 30.

A first portion of the pocket 21, designated 21', is formed in the upper surface of the base wall 22 and comprises a depression formed midway along the apex ridge 29 of the base wall 22 and having a volume corresponding to a portion of a cylinder corresponding to the cylindrical volume of the roll 12. A second portion of pocket 21 designated 21'' is a depression formed midway along the apex ridge 36 of the sidewall 32 and consists also of a volume corresponding to a portion of the cylindrical volume of the roll 12. Correspondingly, as with sidewall 32, sidewall 40 incorporates a third portion of pocket 21 designated 21''' which is generally a portion of a generally cylindrical volume positioned midway along the apex ridge 42 and corresponding to a cylinder of dimensions comparable to that of roll 12.

In the closed position, pockets 21', 21'' and 21''' join to form a single cylindrical pocket 21 having a circular periphery 52 for enclosing the outermost edge of the roll 12.

Referring to FIGS. 3 and 7, projecting cylindrical studs 46 are positioned along a longitudinal edge of the sidewall 40 opposing the hinge 30. Corresponding rectangular sockets 48 are positioned at the longitudinal edge of sidewall 32 opposing from the edge adjacent to hinge 28. When the dispenser 10 is in the closed position, the leading faces of the studs 46 flex the receiving rim of the sockets outward to snap into coaxial embracement. The studs 46 may be repeatedly removed from and refit into the sockets 48 allowing the dispenser to be opened and closed as necessary, yet the interfitting of the studs 46 with the sockets 48 is such as to resist an inadvertent opening of the dispenser when it is in use.

Referring to FIGS. 4 and 6, a slot 56, sized to receive the tape 17, is formed by the abutment of outward face 45 of sidewall 32 and outward face 47 of sidewall 40 when the sidewalls 32 and 40 are in the closed position. The outer rim of the slot 56 is formed by the die cut edge of the sidewalls 32 and 40 which provide a sharp corner suitable for tearing the tape 17 or for de-laminating the backing strip 16 from its carried labels 14.

The slot 56 merges with guide channels 60 and 62 which connect to the periphery 52 of pocket 21 to provide a continuous path between slot 56 and the circumference of the roll 12. At the guide channel 60, periphery 52 of pocket 21" forms a tooth 58 having one face adjacent to periphery 52 and one face adjacent to guide wall 60, the faces meeting at an acute angle to create an edge 64 projecting in a clockwise direction so as to catch a loose end 66 of the strip 16 when the roll 12 is moved in a counterclockwise direction for dispensing.

The longitudinal axis 20 generally passes between outward faces 45 and 47, but not necessarily at the intersection of the apex ridges 36, 42 and 29. Thus rolls 12 of various radii may be accommodated by the same general design of the dispenser 10 with only the pocket 21 adjusted as necessary. It will also be apparent, for this reason, that the area of the rim 26 of the base wall 22 is largely independent of the size of the roll and thus may be made of adequate size to support the dispenser 10 on a work surface.

With the dispenser 10 supported on a work surface by the rim 26, the tape 17 exiting the slot 56 will project generally upward. Thus, a short length of tape 17 may at all time extend from the slot 56, for convenient removal of the tape 17, but without lying objectionably across work area to become soiled or to interfere with work.

Referring now to FIGS. 2 and 5, a thumb hole 70 is cut in sidewall 40 through guide wall 62 so as to be positioned, when sidewalls 32 and 40 are in the closed position, over a stiffening ridge 72 in a location on guide wall 60 across from the thumb hole 70. Referring to FIG. 1, a thumb inserted through thumb hole 70 may capture the tape 17 between the thumb tip and the stiffening ridge 72 to allow advance of the tape 17 or stopping of the tape 17. Referring to FIG. 6, the stiffening rib 72 also allows the dispenser to be used by pulling backing strip 16 downward against the edge of slot 56 at an acute angle with respect to the path formed by guide walls 60 and 62 so as to cause the delamination of the adhesive label 14 as the tape 17 is withdrawn.

Referring to FIG. 2, embossed lettering 76 and 78 may be formed in the material of the tape dispenser 10 during the thermoforming process. The embossed lettering provides instructions to the user in the use of the dispenser and identifies the manufacturer without the need for an opaque label that would obstruct the view of the labels 14 contained within the dispenser 10.

The above description has been that of a preferred embodiment of the present invention. It will occur to those who practice the art that many modifications may be made without departing from the spirit and scope of the invention. For example, although a transparent material is used in the preferred embodiment, colored or opaque materials may equally be used. Further, the package will accommodate a variety of dimensions of rolls with the pockets adjusted accordingly. In particular, the axis of the roll of tape need not be parallel to the hinge edges but may be directed at right angles to the hinge for a more compact design. In order to apprise the public of the various embodiments that may fall within the scope of the invention, the following claims are made.

I claim:

1. A dispenser for a roll of tape comprising:

a base wall formed of a single sheet having opposed parallel first and second side hinge edges and having raised opposed end walls having triangular profiles;

a first side wall formed integrally with the base wall and hingeably attached to the base wall at the first hinge edge to fold between an open position generally co-planar with the base wall and a closed position folded inward toward the base wall, the first side wall also having raised opposed end walls having triangular profiles;

a second side wall formed integrally with the base wall and hingeably attached to the base wall at the second hinge edge also to fold between an open position generally co-planar with the base wall and a closed position folded inward toward the base wall, the second side wall also having raised opposed end walls having triangular profiles, the first and second side walls together forming a cylindrical pocket in the closed position for retaining the roll so that the roll is free to rotate about its axis for dispensing of the tape and for allowing insertion of the roll between the first and second side walls in the open position, the pocket having a longitudinal central axis around which the roll can rotate when positioned in the pocket;

a dispensing slot formed by the abutment of the first side wall and the second side wall, the slot being sized to allow removal of a part of the tape of the roll therethrough from the pocket and whereby rotation of the roll about the axis of the roll is in response to the removal of the tape;

whereby upon folding the side walls into the closed position each of the end walls is positioned adjacent to two other end walls such that the closed dispenser presents triangular end profiles; and wherein said central longitudinal axis of the pocket is substantially parallel to the first and second hinge edges.

2. The dispenser of claim 1, wherein the base wall defines a planar surface for supporting the dispenser on a substantially horizontal surface, and wherein the slot is positioned on ends of the first and second side walls opposite the base wall such that it is above the base wall when the base wall is on said horizontal surface and permits removal of said part of the tape upward with respect to the planar surface.

3. The dispenser of claim 1, wherein the pocket has a generally circular periphery and wherein the pocket communicates at its circular periphery with a tooth that has an edge directed against the rotation of the roll as tape is removed off of the roll.

4. The dispenser of claim 1, wherein the base wall and the first and second side walls are constructed from a single piece of transparent polymer material.

5. The dispenser of claim 1, further comprises at least one releasable fastener to hold the first and second side walls in the closed position.

6. The dispenser of claim 5, wherein the releasable fastener comprises mating male and female embossments formed in the first and second sides for releasably interfitting in the closed position.

7. The dispenser of claim 1, wherein a hole is cut through the first side wall so as to permit a human finger to move the tape.

8. The dispenser of claim 7, wherein the hole is positioned to allow the compression of the tape against the second side wall by the finger.

* * * * *